US012473806B1

(12) United States Patent
Sun et al.

(10) Patent No.: US 12,473,806 B1
(45) Date of Patent: Nov. 18, 2025

(54) LOW-TO-MEDIUM MATURITY SHALE OIL EXTRACTION SYSTEM BASED ON CURTAILED POWER HEATING

(71) Applicant: INSTITUTE OF GEOLOGY AND GEOPHYSICS, CHINESE ACADEMY OF SCIENCES, Beijing (CN)

(72) Inventors: Xiukuo Sun, Beijing (CN); Zhaobin Zhang, Beijing (CN); Xiao Li, Beijing (CN); Shouding Li, Beijing (CN); Jianming He, Beijing (CN); Guanfang Li, Beijing (CN); Bo Zheng, Beijing (CN); Tianqiao Mao, Beijing (CN); Yanzhi Hu, Beijing (CN); Tao Xu, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 19/083,460

(22) Filed: Mar. 19, 2025

(30) Foreign Application Priority Data

Jul. 12, 2024 (CN) ..... 202410932115.8

(51) Int. Cl.
*E21B 43/24* (2006.01)
*E21B 43/241* (2006.01)
*E21B 47/07* (2012.01)

(52) U.S. Cl.
CPC ..... *E21B 43/2401* (2013.01); *E21B 43/241* (2013.01); *E21B 47/07* (2020.05); *E21B 2200/20* (2020.05)

(58) Field of Classification Search
CPC .... E21B 43/2401; E21B 43/24; E21B 43/241; E21B 2200/20
See application file for complete search history.

(56) References Cited

U.S. PATENT DOCUMENTS

2010/0282460 A1* 11/2010 Stone ..... E21B 43/2401 700/29
2014/0262221 A1 9/2014 Clark et al.
(Continued)

FOREIGN PATENT DOCUMENTS

CN 102261238 A 11/2011
CN 106499376 A * 3/2017 ..... E21B 43/295
(Continued)

*Primary Examiner* — George S Gray
(74) *Attorney, Agent, or Firm* — Bayramoglu Law Offices LLC

(57) ABSTRACT

A low-to-medium maturity shale oil extraction system based on curtailed power heating includes a transmission line with an input terminal electrically connected to curtailed power from a wind and PV power generation base and an output terminal electrically connected to an input terminal of a surface control platform, where downhole electric heaters are located inside a heating well; the heating well penetrates through an upper sealing layer and is located in a reservoir; downhole temperature and pressure monitoring controllers are provided in the heating well; the downhole temperature and pressure monitoring controller is electrically connected to the downhole electric heater; and a production well penetrates through the upper sealing layer and is located at a side of the heating well adjacent to the ground in the reservoir. The system avoids resource waste caused by power curtailment, enhances energy utilization efficiency, and improves the mobility and recoverability of shale oil.

7 Claims, 1 Drawing Sheet

(56) References Cited

U.S. PATENT DOCUMENTS

| | | | | |
|---|---|---|---|---|
| 2022/0034213 | A1 | 2/2022 | Hou et al. | |
| 2022/0325885 | A1* | 10/2022 | Wu | F22B 35/008 |

FOREIGN PATENT DOCUMENTS

| | | | |
|---|---|---|---|
| CN | 109138976 | A | 1/2019 |
| CN | 110159242 | A | 8/2019 |
| CN | 117605447 | A | 2/2024 |

* cited by examiner

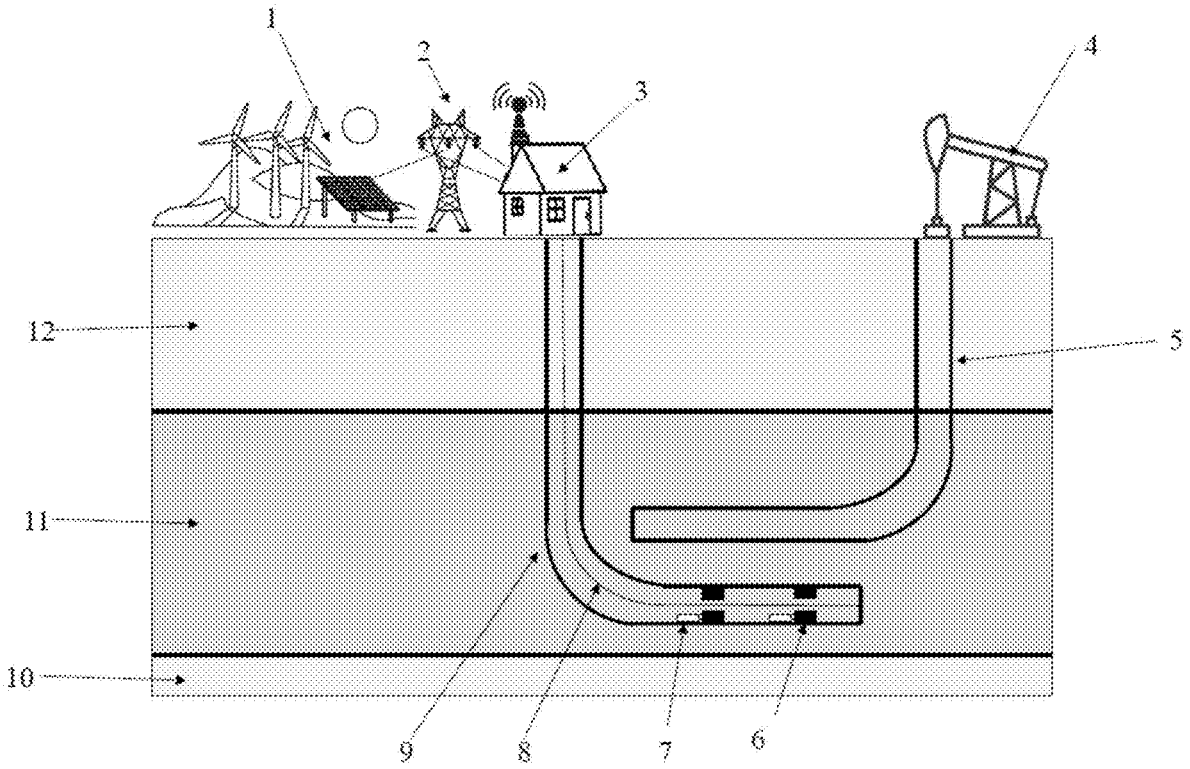
Figure

LOW-TO-MEDIUM MATURITY SHALE OIL EXTRACTION SYSTEM BASED ON CURTAILED POWER HEATING

CROSS REFERENCE TO THE RELATED APPLICATIONS

This application is based upon and claims priority to Chinese Patent Application No. 202410932115.8, filed on Jul. 12, 2024, the entire contents of which are incorporated herein by reference.

TECHNICAL FIELD

The present disclosure belongs to the field of shale oil development and energy utilization, and specifically relates to a low-to-medium maturity shale oil extraction system based on curtailed power heating.

BACKGROUND

The prior art faces a contradiction between the rapid growth of wind and photovoltaic (PV) power generation and insufficient local absorption capacity coupled with delayed construction of power transmission channels in some regions, leading to high curtailment rates, especially in wind and PV power generation.

Low-to-medium maturity shale oil is a general term for lower maturity hydrocarbons found in organic-rich shale, and the low-to-medium maturity shale oil must rely on subsurface in-situ conversion technology to heat a reservoir underground. The heating process is intended to promote the cracking of unconverted hydrocarbons, heavy oil, and kerogen in the organic-rich shale into lighter oil. It can improve the fluidity of lower maturity oil, promoting the flow of the oil from the reservoir into the wellbore. Therefore, heating the low-to-medium maturity shale oil reservoir is the technical core for achieving its large-scale commercial development.

Wind and PV power generation are characterized by instability and strong fluctuations, and there are peak and trough periods of electricity supply. Consequently, utilizing curtailed power for electric heating cannot adopt traditional stable electric heating methods and requires innovative approaches.

In view of this, the present disclosure proposes a low-to-medium maturity shale oil extraction system based on curtailed power heating.

SUMMARY

The present disclosure aims to solve the above-mentioned problems in the prior art. That is, the prior art faces a contradiction between the rapid growth of wind and photovoltaic (PV) power generation and insufficient local absorption capacity coupled with delayed construction of power transmission channels in some regions, leading to high curtailment rates, especially in wind and PV power generation. The development of low-to-medium maturity shale oil requires a stable heat source, whereas the traditional electric heating technology cannot efficiently utilize the unstable curtailed power, hindering efficient resource utilization and energy structure optimization. To this end, the present disclosure provides a low-to-medium maturity shale oil extraction system based on curtailed power heating, including a transmission line, a surface control platform, a production well, downhole electric heaters, downhole temperature and pressure monitoring controllers, and a heating well, wherein the transmission line includes an input terminal electrically connected to curtailed power from a wind and PV power generation base and an output terminal electrically connected to an input terminal of the surface control platform; and the surface control platform is configured to convert a voltage of the curtailed power into a stable working voltage for the downhole electric heaters and output the power to the downhole electric heaters;

the downhole electric heaters are located inside the heating well; the heating well penetrates through an upper sealing layer and is located in a reservoir; the downhole temperature and pressure monitoring controllers are provided in the heating well; the downhole temperature and pressure monitoring controller is electrically connected to the downhole electric heater; and the downhole temperature and pressure monitoring controller is configured to control on/off of the downhole electric heater, and detect and upload a temperature and a pressure at a corresponding position of the downhole electric heater to the surface control platform; and the production well penetrates through the upper sealing layer and is located at a side of the heating well adjacent to the ground in the reservoir.

In some preferred implementations, each of the heating well and the production well includes a vertical section and a horizontal section; and the horizontal section of the heating well is located below the horizontal section of the production well.

In some preferred implementations, the downhole electric heaters are arranged at equal intervals on an inner wall of the horizontal section of the heating well; and the downhole electric heaters are configured to heat the reservoir.

In some preferred implementations, the downhole temperature and pressure monitoring controllers are arranged at equal intervals on an inner wall of the horizontal section of the heating well; and the downhole temperature and pressure monitoring controllers have a same quantity as the downhole electric heaters.

In some preferred implementations, a wellhead of the production well is connected to a pumping unit; and the pumping unit is provided on the ground where the wellhead of the production well is located.

In some preferred implementations, the surface control platform is configured to transmit stabilized power to the downhole electric heater through a heating well cable; and the downhole temperature and pressure monitoring controller is configured to upload the temperature and the pressure at the corresponding position of the downhole electric heater to the surface control platform through the heating well cable.

In some preferred implementations, the surface control platform is further configured to receive temperature and pressure data and a transmission line input signal and transmit the temperature and pressure data and the transmission line input signal to a decision-making terminal through a wireless real-time transmission module; and the decision-making terminal is configured to generate a decision signal based on data corresponding to the temperature and the pressure and real-time input power of the transmission line, and transmit the decision signal to the surface control platform through the wireless real-time transmission module, such that the surface control platform controls a turn-on time, position and quantity of the downhole electric heaters based on the decision signal.

In some preferred implementations, the decision-making terminal generates the decision signal based on the data corresponding to the temperature and the pressure and the real-time input power of the transmission line by:

dynamically adjusting the downhole electric heaters based on an objective optimization algorithm, a numerical simulation algorithm and a preset determination principle according to the real-time input power of the transmission line and temperature and pressure data detected in real time underground, and determining the turn-on position, quantity and time of the downhole electric heaters.

In some preferred implementations, the preset determination principle is as follows:

a heating temperature at a corresponding position of a single downhole electric heater after being turned on is higher than a complete decomposition temperature of kerogen;

based on the real-time input power of the transmission line, a target optimization analysis is conducted on the turn-on quantity and position of the downhole electric heaters, and the downhole electric heaters are dynamically adjusted with a goal of maximizing decomposition efficiency of the kerogen;

a percentage of kerogen decomposition corresponding to a control volume of the downhole electric heater in the reservoir is calculated, and the downhole electric heater in an area with the percentage of kerogen decomposition greater than or equal to a preset threshold is preferentially turned off; and when there is still residual power in case the downhole electric heaters in all areas with the percentage of kerogen decomposition less than the preset threshold are turned on, the downhole electric heater in the area with the percentage of kerogen decomposition greater than or equal to the preset threshold is turned on; and based on the numerical simulation algorithm, cumulative input power and heating history of the curtailed power used to heat the reservoir from the beginning of well construction are calculated, a mass of liquid hydrocarbon and gaseous hydrocarbon produced is numerically simulated, and an optimal production window is analyzed.

In some preferred implementations, when the reservoir is heated through the curtailed power and the heating well, a downhole formation pressure is monitored by the production well; and when the pressure meets a set production pressure, the production well enters a production stage, and the pumping unit operates for production.

The present disclosure has following beneficial effects:

The present disclosure enables efficient utilization of curtailed power resources. The present disclosure directly applies the curtailed power from wind and PV power generation to the heating process of the low-to-medium maturity shale oil reservoir, effectively solving the problem of resource waste caused by large-scale curtailment and improving overall energy efficiency.

The present disclosure promotes shale oil commercialization. It incorporates an intelligent heating system tailored to properties of the medium-low maturity shale oil, dynamically adapting to curtailment fluctuations, optimizing heating strategies, and accelerating efficient cracking of kerogen and other organics. This significantly improves mobility and recoverability of shale oil, providing a viable technical pathway for large-scale commercial development of low-to-medium maturity shale oil.

The present disclosure ensures grid stability. By constructing a dedicated high-voltage transmission line to deliver the curtailed power to the production area, the present disclosure avoids the impact of directly integrating the curtailed power on the stability of the power grid and ensuring the safe operation of the power system.

The present disclosure can achieve environmentally friendly development. The present disclosure uses clean curtailed power as a heating energy source to replace traditional fossil fuel heating methods, reducing carbon emissions and the generation of other pollutants.

The present disclosure delivers dual technical and economic benefits. The present disclosure enables precise management and optimization of the heating process through the intelligent control system. It shortens reservoir heating cycles and maximizes kerogen decomposition efficiency, boosting crude oil yield and generating significant economic returns.

BRIEF DESCRIPTION OF THE DRAWINGS

Other features, objectives and advantages of the present disclosure will become more apparent upon reading the detailed description of the non-restrictive embodiments with reference to the following drawings.

FIGURE is an overall structural schematic diagram of a low-to-medium maturity shale oil extraction system based on curtailed power heating according to the present disclosure.

DETAILED DESCRIPTION OF THE EMBODIMENTS

The present disclosure will be further described in detail below with reference to the drawings and embodiments. It should be understood that the specific embodiments described herein are merely intended to explain the present disclosure, rather than to limit the present disclosure. It should also be noted that, for convenience of description, only the parts related to the present disclosure are shown in the drawings.

It should be noted that the embodiments in the present disclosure and features in the embodiments may be combined with each other in a non-conflicting situation. The present disclosure will be described in detail below with reference to the drawings and embodiments.

As shown in FIGURE, the present disclosure provides a low-to-medium maturity shale oil extraction system based on curtailed power heating, including transmission line 2, surface control platform 3, production well 5, downhole electric heaters 6, downhole temperature and pressure monitoring controllers 7, and heating well 9.

The transmission line 2 includes an input terminal electrically connected to curtailed power from wind and photovoltaic (PV) power generation base 1 and an output terminal electrically connected to an input terminal of the surface control platform 3. The surface control platform 3 is configured to convert a voltage of the curtailed power into a stable working voltage for the downhole electric heaters 6 and output the power to the downhole electric heaters 6.

The downhole electric heaters 6 are located inside the heating well 9. The heating well 9 penetrates through upper sealing layer 12 and is located in reservoir 11. The downhole temperature and pressure monitoring controllers 7 are provided in the heating well 9. The downhole temperature and pressure monitoring controller 7 is electrically connected to the downhole electric heater 6. The downhole temperature and pressure monitoring controller 7 is configured to control on/off of the downhole electric heater 6, and detect and upload a temperature and a pressure at a corresponding position of the downhole electric heater 6 to the surface control platform 3.

The production well 5 penetrates through upper sealing layer 12 and is located at a side of the heating well 9 adjacent to the ground in the reservoir 11.

The wind and PV power generation base 1 is adjacent to a target production area. To avoid affecting the normal grid connection of the wind and PV power generation bases, a dedicated high-voltage transmission line is constructed as the transmission line 2 to transport the high-voltage curtailed power of the wind and PV power generation base 1 to the target production area.

The surface control platform 3 is constructed on the ground of the target low-to-medium maturity shale oil drilling and production area.

The downhole electric heaters 6 are high-temperature, high-pressure, and waterproof electric heaters.

The downhole temperature and pressure monitoring controllers 7 are temperature and pressure monitors that are resistant to high temperature, high pressure, and water. The downhole temperature and pressure monitoring controller 7 is paired with the downhole electric heater 6.

Lower sealing layer 10 of the low-to-medium maturity shale oil reservoir is located below the reservoir 11.

The reservoir 11 is a target heating layer and production layer.

The surface control platform 3 is configured to convert the voltage of the curtailed power into a stable working voltage for the downhole electric heater 6. Specifically, the high-voltage power input by the transmission line 2 is converted into low-voltage power for the downhole electric heater 6.

As a further explanation of the present disclosure, referring to FIGURE, each of the heating well 9 and the production well 5 includes a vertical section and a horizontal section. The horizontal section of the heating well 9 is located below the horizontal section of the production well 5.

A wall of the horizontal section of the production well 5 is perforated with holes to facilitate the inflow of movable hydrocarbons converted from low-to-medium maturity shale oil into the production well 5.

A wall of the horizontal section of the heating well 9 is made of a high-temperature and high-pressure resistant material.

In the implementation of the present disclosure, two wells, namely the heating well 9 and the production well 5, are constructed in the target low-to-medium maturity shale oil drilling and production area. To improve production efficiency, the horizontal sections of the heating well 9 and the production well 5 are designed at the position of the reservoir 11. The horizontal section is generally 2,000-2,500 m long, and generally, there is a distance of about 50 m between the production well 5 and the heating well 9 is.

The heat generated by heating diffuses within a certain range, generally a range of several tens of meters. Therefore, in order to ensure that all decomposed oil flows into the production well 5, the well spacing should not be too large. Generally, 50 m is sufficient to meet the ideal requirement.

As a further explanation of the present disclosure, referring to FIGURE, the downhole electric heaters 6 are arranged at equal intervals on an inner wall of the horizontal section of the heating well 9, and the downhole electric heaters 6 are configured to heat the reservoir 11.

As a further explanation of the present disclosure, referring to FIGURE, the downhole temperature and pressure monitoring controllers 7 are arranged at equal intervals on an inner wall of the horizontal section of the heating well 9. The downhole temperature and pressure monitoring controllers 7 have a same quantity as the downhole electric heaters 6.

The downhole electric heaters 6 are arranged with a spacing of generally 5-10 m in the horizontal section of the heating well 9 through continuous tubing, and are symmetrically distributed at a 180° angle inside the wall. Meanwhile, the downhole temperature and pressure monitoring controllers 7 is symmetrically distributed with the downhole electric heater 6. In addition, a cable is laid inside the heating well 9 for power transmission and signal transmission, and it is connected to the downhole electric heater 6 and the downhole temperature and pressure monitoring controller 7.

As a further explanation of the present disclosure, referring to FIGURE, the wellhead of the production well 5 is connected to pumping unit 4. The pumping unit 4 is provided on the ground where the wellhead of the production well 5 is located.

The pumping unit 4 is configured to extract oil from the production well 5 during a production stage.

As a further explanation of the present disclosure, referring to FIGURE, the surface control platform 3 transmits stabilized power to the downhole electric heater 6 through heating well cable 8.

The downhole temperature and pressure monitoring controller 7 uploads the temperature and the pressure at the corresponding position of the downhole electric heater 6 to the surface control platform 3 through the heating well cable 8.

As a further explanation of the present disclosure, an intelligent decision-making system is constructed for heating the low-to-medium maturity shale oil reservoir through curtailed power. Due to the unstable and highly fluctuating input power of curtailed power, it is necessary to dynamically identify and adjust the underground heating method based on the input power, so as to achieve efficient decomposition of reservoir kerogen and efficient power utilization. Specifically:

The surface control platform 3 is further configured to receive temperature and pressure data and a transmission line input signal and transmit the temperature and pressure data and the transmission line input signal to a decision-making terminal through a wireless real-time transmission module.

The decision-making terminal generates a decision signal based on data corresponding to the temperature and the pressure and real-time input power of the transmission line, and transmits the decision signal to the surface control platform 3 through the wireless real-time transmission module. The surface control platform 3 controls the turn-on time, position and quantity of the downhole electric heaters 6 based on the decision signal.

The decision-making terminal refers to a decision-making system.

As a further explanation of the present disclosure, the decision-making terminal generates the decision signal based on the data corresponding to the temperature and the pressure and the real-time input power of the transmission line by:

Based on an objective optimization algorithm, a numerical simulation algorithm and a preset determination principle according to the real-time input power of the transmission line and temperature and pressure data detected in real time underground, the downhole electric heaters 6 are dynamically adjusted to determine the turn-on position, quantity and time of the downhole electric heaters.

As a further explanation of the present disclosure, the preset determination principle is as follows:

A heating temperature at a corresponding position of a single downhole electric heater 6 after being turned on is higher than a complete decomposition temperature of kerogen.

Based on the real-time input power of the transmission line, a target optimization analysis is conducted on the turn-on quantity and position of the downhole electric heaters 6, and the downhole electric heaters 6 are dynamically adjusted with a goal of maximizing decomposition efficiency of the kerogen.

A percentage of kerogen decomposition corresponding to a control volume of the downhole electric heater 6 in the reservoir 11 is calculated, and the downhole electric heater 6 in an area with the percentage of kerogen decomposition greater than or equal to a preset threshold is preferentially turned off. When there is still residual power in case the downhole electric heaters 6 in all areas with the percentage of kerogen decomposition less than the preset threshold are turned on, the downhole electric heater 6 in the area with the percentage of kerogen decomposition greater than or equal to the preset threshold is turned on.

Based on the numerical simulation algorithm, cumulative input power and heating history of the curtailed power used to heat the reservoir 11 from the beginning of well construction are calculated, a mass of liquid hydrocarbon and gaseous hydrocarbon produced is numerically simulated, and an optimal production window is analyzed.

The complete decomposition temperature of the kerogen is 600K.

In this embodiment, the preset threshold is preferably 80%.

In the present disclosure, specifically, the percentage of kerogen decomposition refers to the mass of kerogen decomposed in an electric heater controlled area divided by the total initial weight of kerogen in that area. The rate of kerogen decomposition is initially fast. However, as the decomposition percentage increases, the rate of kerogen decomposition slows down. The threshold for the percentage of kerogen decomposition can be set by technicians in this art based on actual surveys. In this embodiment, for example, when the threshold for the percentage of kerogen decomposition is set to 80%, the electric heater located in an area with the percentage of kerogen decomposition less than 80% is first turned on. At the beginning, the electric heater in an area with the percentage of kerogen decomposition greater than 80% is turned off. The electric heater in an area with the percentage of kerogen decomposition greater than the decomposition threshold can only be turned on when all the electric heaters in areas with the percentage of kerogen decomposition less than 80% are turned on. The purpose of this method is to ensure that the kerogen in the reservoir has high decomposition efficiency, thereby fully utilizing the electrical energy.

As a further explanation of the present disclosure, referring to FIGURE, when the reservoir 11 is heated through the curtailed power and the heating well 9, a downhole formation pressure is monitored by the production well 5. When the pressure meets a set production pressure, the production stage comes, and the pumping unit 4 operates for production.

In this embodiment, it is recommended to set the heating stage as 3 years. During the heating stage, the production well 5 does not produce. After the heating stage is completed, it enters the production stage and heating is stopped.

In the description of the present disclosure, terms such as "central", "upper", "lower", "left", "right", "vertical", "horizontal", "inner", and "outer" indicate orientation or position relationships based on the drawings. They are merely intended to facilitate description, rather than to indicate or imply that the mentioned apparatus or components must have the specific orientation and must be constructed and operated in the specific orientation. Therefore, these terms should not be construed as a limitation to the present disclosure. Moreover, the terms "first", "second", and "third" are used only for the purpose of description, and are not intended to indicate or imply relative importance.

In addition, it should be noted that in the description of the present disclosure, unless otherwise clearly specified, meanings of terms "install", "connect with" and "connect to" should be understood in a broad sense. For example, the connection may be a fixed connection, a removable connection, or an integral connection, may be a mechanical connection or an electrical connection, may be a direct connection or an indirect connection via a medium, and may be an internal connection between two components. Those skilled in the art should understand the specific meanings of the above terms in the present disclosure based on specific situations.

Terms "include", "comprise" or any other variations thereof are intended to cover non-exclusive inclusions, so that a process, a method, an article, or a device/apparatus including a series of elements not only includes those elements, but also includes other elements that are not explicitly listed, or also includes inherent elements of the process, the method, the article or the device/apparatus.

The technical solutions of the present disclosure are described in the preferred implementations with reference to the drawings. Those skilled in the art should easily understand that the protection scope of the present disclosure is apparently not limited to these specific implementations. Those skilled in the art can make equivalent changes or substitutions to the relevant technical features without departing from the principles of the present disclosure, and the technical solutions derived by making these changes or substitutions should fall within the protection scope of the present disclosure.

What is claimed is:

1. A shale oil extraction method based on power heating, wherein said method is performed at least in part by a shale oil extraction system including a transmission line, a surface control platform, a production well, downhole electric heaters, downhole temperature and pressure monitoring controllers, and a heating well, wherein the transmission line comprises an input terminal electrically connected to a first power from a wind and photovoltaic (PV) power generation base and an output terminal electrically connected to an input terminal of the surface control platform, the shale oil extraction method comprising:

converting, by the surface control platform, a first voltage of the first power into a second voltage for the downhole electric heaters to obtain a second power, wherein the second voltage is a stable working voltage for the downhole electric heaters;

outputting, by the surface control platform, the second power to the downhole electric heaters, wherein the downhole electric heaters are located inside the heating well, wherein the heating well penetrates through an upper sealing layer, wherein the heating well is located in a reservoir, wherein the downhole temperature and pressure monitoring controllers are provided in the heating well, wherein the downhole temperature and pressure monitoring controllers are respectively electrically connected to the downhole electric heaters;

controlling, by the downhole temperature and pressure monitoring controllers, on/off of the downhole electric heaters, and detecting and uploading, by the downhole temperature and pressure monitoring controllers, temperature and pressure data at a corresponding position of the downhole electric heaters to the surface control platform, wherein the production well penetrates through the upper sealing layer and is located at a side of the heating well;

receiving, by the surface control platform, the temperature and pressure data and a transmission line input signal;

transmitting, by the surface control platform, the temperature and pressure data and the transmission line input signal to a decision-making terminal through a wireless real-time transmission module;

generating, by the decision-making terminal, a decision signal based on the temperature and pressure data and real-time input power of the transmission line;

transmitting, by the decision-making terminal, the decision signal to the surface control platform through the wireless real-time transmission module;

controlling, by the surface control platform, a turn-on time, a turn-on position and a turn-on quantity of the downhole electric heaters based on the decision signal;

generating, by the decision-making terminal, the decision signal based on the temperature and pressure data and the real-time input power of the transmission line;

dynamically adjusting, by the decision-making terminal, the downhole electric heaters based on an and a preset determination principle according to the real-time input power of the transmission line and the temperature and pressure data detected in real time underground; and determining, by the decision-making terminal, the turn-on position, the turn-on quantity and the turn-on time of the downhole electric heaters, wherein the preset determination principle includes: a heating temperature at a corresponding position of a single downhole electric heater after being turned on is higher than a decomposition temperature of kerogen;

based on the real-time input power of the transmission line, conducting a target optimization analysis on the turn-on quantity and the turn-on position of the downhole electric heaters; and wherein the downhole electric heaters are dynamically adjusted to increase decomposition efficiency of the kerogen;

calculating a percentage of kerogen decomposition corresponding to a control volume of each of the downhole electric heaters in the reservoir is calculated, and wherein the downhole electric heater in an area with the percentage of kerogen decomposition greater than or equal to a preset threshold is turned off; and when there is still residual power in case the downhole electric heaters in all areas with the percentage of kerogen decomposition less than the preset threshold are turned on, the downhole electric heater in the area with the percentage of kerogen decomposition greater than or equal to the preset threshold is turned on;

calculating cumulative input power and a heating history of the first power used to heat the reservoir from a beginning of a well construction; and numerically simulating a mass of a liquid hydrocarbon and a mass of a gaseous hydrocarbon produced by the production well, and determining a production window based on the numerically simulating, wherein the production window is a time when production of the shell oil begins and is performed.

2. The shale oil extraction method according to claim 1, wherein each of the heating well and the production well comprises a vertical section and a horizontal section;

and the horizontal section of the heating well is located below the horizontal section of the production well.

3. The shale oil extraction method according to claim 2, wherein the downhole electric heaters are arranged at equal intervals on an inner wall of the horizontal section of the heating well, wherein the shale oil extraction method further comprises heating the reservoir by the downhole electric heaters.

4. The shale oil extraction method according to claim 1, wherein the downhole temperature and pressure monitoring controllers are arranged at equal intervals on an inner wall of a horizontal section of the heating well; and a total number of the downhole temperature and pressure monitoring controllers is equal to a total number of the downhole electric heaters.

5. The shale oil extraction method according to claim 1, wherein a wellhead of the production well is connected to a pumping unit; and the pumping unit is provided on the ground where the wellhead of the production well is located.

6. The shale oil extraction method according to claim 1, further comprising:

transmitting, by the surface control platform, the second power to the downhole electric heaters through a heating well cable; and uploading, by the downhole temperature and pressure monitoring controllers, the temperature and pressure data at the corresponding position of the downhole electric heaters to the surface control platform through the heating well cable.

7. The shale oil extraction method according to claim 1, wherein when the downhole formation pressure meets a set production pressure, the production well enters a production stage, and a pumping unit operates for production.

* * * * *